US005328799A

United States Patent [19]

Freedman et al.

[11] Patent Number: 5,328,799

[45] Date of Patent: Jul. 12, 1994

[54] THERMOGRAPHIC AND PHOTOTHERMOGRAPHIC IMAGING MATERIALS

[75] Inventors: James R. Freedman, Newton Centre; Stephen R. Sofen, Lexington; Kent M. Young, Carlisle, all of Mass.

[73] Assignee: Polaroid Corporation, Cambridge, Mass.

[21] Appl. No.: 79,146

[22] Filed: Jun. 17, 1993

Related U.S. Application Data

[63] Continuation-in-part of Ser. No. 923,858, Jul. 31, 1992, abandoned.

[51] Int. Cl.[5] ..... G03C 5/54

[52] U.S. Cl. ..... 430/200; 430/203; 430/218; 430/222; 430/618; 430/619; 430/620; 430/964

[58] Field of Search ..... 430/203, 214, 218, 222, 430/618, 619, 620, 964, 200

[56] References Cited

U.S. PATENT DOCUMENTS

| | | | |
|---|---|---|---|
| 3,719,489 | 6/1971 | Cieciuch et al. | 430/222 |
| 3,893,855 | 7/1975 | Charkoudian | 96/3 |
| 4,060,417 | 11/1977 | Cieciuch et al. | 430/222 |
| 4,098,783 | 7/1978 | Cieciuch et al. | 260/147 |
| 4,168,169 | 9/1979 | Humphlett et al. | 96/53 |
| 4,168,170 | 9/1979 | Mowrey et al. | 96/53 |
| 4,719,168 | 1/1988 | Nakamura et al. | 430/203 |
| 4,740,448 | 4/1988 | Kliem | 430/214 |
| 4,948,698 | 8/1990 | Komamura | 430/203 |
| 5,084,376 | 1/1992 | Suda et al. | 430/617 |

FOREIGN PATENT DOCUMENTS 59-180548 10/1984 Japan .

*Primary Examiner*—Richard L. Schilling

*Attorney, Agent, or Firm*—Carol A. Loeschorn; Edward W. Black

[57] ABSTRACT

Photothermographic and thermographic diffusion transfer image-recording materials are provided wherein an auxiliary ligand for silver ions is employed to enhance transfer image density and discrimination.

38 Claims, No Drawings

THERMOGRAPHIC AND PHOTOTHERMOGRAPHIC IMAGING MATERIALS

CROSS-REFERENCE TO RELATED APPLICATIONS

This application is a continuation-in-part of copending U.S. patent application Ser. No. 07/923,858, filed Jul. 31, 1992 (now abandoned).

BACKGROUND OF THE INVENTION (1) Field of the Invention

The present invention relates to heat-developable color thermographic and photothermographic image-recording materials and more particularly to ones capable of providing images having good image discrimination as well as enhanced image density.

(2) Description of the Related Art

It is well known that various cleavage reactions are assisted by silver ions including reactions involving cleavage of a compound into one or more fragments.

U.S. Pat. No. 3,719,489 discloses silver ion assisted cleavage reactions useful in photographic systems. As disclosed therein, photographically inert compounds are capable of undergoing cleavage in the presence of silver ions made available imagewise during processing of a silver halide emulsion to liberate a reagent, such as, a photographically active reagent or a dye in an imagewise distribution corresponding to that of said silver ions. In one embodiment disclosed therein, color images are produced by using as the photographically inert compounds, color providing compounds which are substantially non-diffusible in the photographic processing composition but capable of undergoing cleavage in the presence of the imagewise distribution of silver ions and/or soluble silver complex made available in the undeveloped and partially developed areas of a silver halide emulsion as a function of development to liberate a more mobile and diffusible color-providing moiety in an imagewise distribution corresponding to the imagewise distribution of said ions and/or said complex. The subsequent formation of a color image is the result of the differential in diffusibility between the parent compound and liberated color-providing moiety whereby the imagewise distribution of the more diffusible color-providing moiety released in the undeveloped and partially developed areas is free to transfer.

Color-providing compounds useful in the above process form the subject matter of U.S. Pat. No. 4,098,783, a continuation in part of said U.S. Pat. No. 3,719,489. The color-providing compounds disclosed therein may comprise one or more dye radicals and one or more 1,3-sulfur-nitrogen moieties. For example, they may comprise one complete dye or dye intermediate and one cyclic 1,3-sulfur-nitrogen moiety. Alternatively, the color-providing compounds may comprise two or more cyclic moieties for each dye radical or dye intermediate and vice versa.

Thermally developable black and white as well as color photosensitive materials, whose development is effected by heating, are well known. Among the systems designed to give color images are those wherein a diffusible dye is released as a result of the heat development of an organic silver salt and transferred to the image-receiving layer whereby a color image is obtained.

Japanese Kokai 59-180548 having a Laid-Open date of Oct. 13, 1984 discloses a heat-developable silver halide photosensitive imaging system wherein the dye-providing material contains a heterocyclic ring containing a nitrogen atom and a sulfur or selenium atom which heterocyclic ring is subject to cleavage in the presence of silver ions to release a diffusible dye. An example of a suitable dye-providing material is a thiazolidine dye such as disclosed in the aforementioned U.S. Pat. No. 4,098,783. The process involves imagewise exposing the photosensitive system to light and subsequently or simultaneously heating the photosensitive system, in the presence of a base or base precursor, under a substantially water-free condition whereby an oxidation-reduction reaction between the exposed photosensitive silver halide and a reducing agent occurs. In the exposed areas a negative silver image is formed. In the unexposed areas, the silver ion, present in inverse proportion to the silver image, causes the heterocyclic ring of the dye-providing material to be cleaved releasing a diffusible dye. The diffusible dye is then transferred to an image-receiving layer whereby a positive dye image is formed.

Copending U.S. patent application Ser. No. 07/944,898 of J. R. Freedman et al, filed Dec. 22, 1992, describes a thermographic dye-transfer image-recording material wherein a silver salt complex is utilized as the source of silver ions made available upon imagewise heating to cleave a dye-providing material.

A heat-developable photosensitive system useful in terms of thermal development of the silver halide latent image is one which comprises a support carrying a photosensitive silver halide, a silver salt oxidizer, a thermal solvent, a reducing agent for the silver salt, a binder, preferably gelatin, and a dye-providing material capable of releasing dye upon silver ion assisted cleavage. However, in this type of system there has been difficulty in obtaining both adequate silver development and sufficient dye release.

It has now been found that, by including an auxiliary ligand capable of complexing with the silver ions of the silver salt oxidizing material in the imaging materials of the present invention, accelerated silver development, enhanced image density and improved image discrimination are obtained.

SUMMARY OF THE INVENTION

According to the present invention, an auxiliary ligand is utilized to complex silver ions from the silver salt oxidizing material so that the silver ions are more capable of reaching the dye-providing material where they are then available to cleave the dye-providing material to release a diffusible dye.

The present invention, therefore, provides for thermographic and photothermographic materials containing an auxiliary ligand for silver ions.

Other provisions of the invention will in part be obvious and will in part appear hereinafter.

The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description.

DETAILED DESCRIPTION OF THE INVENTION

The present invention provides heat-processed color image-recording materials comprising (a) a support carrying in one or more layers a dye-providing material capable of releasing a diffusible dye upon cleavage in the presence of silver ions and/or a soluble silver complex, a silver salt oxidizing material, a thermal solvent, and a binder; and, (b) on the same or a second support an image-receiving layer capable of receiving the diffusible dye released from said dye-providing material, wherein said heat-processed image-recording material additionally includes an auxiliary ligand capable of complexing with silver ions, said auxiliary ligand dissolving sufficient silver salt oxidizing material to provide a total concentration of silver species greater than or equal to twice the concentration obtained in the absence of the auxiliary ligand. In another embodiment, the heat-processed image-recording material additionally includes a photosensitive silver halide and a reducing agent.

In a preferred embodiment, the thermographic and photothermographic image-recording materials are processed and the images transferred in the absence of a base or base precursor. Base precursors are materials which generate a base under the processing conditions.

The auxiliary ligand must be capable of forming a complex with the silver ions of the silver salt oxidizing material so as to provide a total silver ion species solubility greater than or equal to twice the concentration obtained in the absence of the auxiliary ligand. The silver complex formed should be relatively stable under the thermal conditions employed and must be subsequently capable of giving up the silver ions both to the dye-providing material and to the silver speck formed upon exposure. Including the auxiliary ligand in the heat-processed image-recording materials results in enhanced image density, improved image discrimination and, in the photothermographic materials, accelerated silver development.

Useful auxiliary ligands are those which form complexes with the silver of the silver salt oxidizing material and have been found to dissolve sufficient silver salt oxidizing material to provide a total concentration of silver species greater than or equal to twice the concentration obtained in the absence of the auxiliary ligand in water at the concentration and pH conditions of application.

Appropriate silver ion ligands may be chosen by calculating the solubility of the silver containing species under the concentration and pH conditions of application in water using equilibrium constants such as those found in the volumes by A. E. Martell and R. M. Smith titled "Critical Stability Constants," published by Plenum Press, New York, N.Y. Calculations may be carried out as described in "Ionic Equilibrium" by J. N. Butler, Addison-Wesley, Reading, Mass., 1964, or in "The Study of Ionic Equilibria" by H. Rossotti, Longman, New York, N.Y., 1978, or using computer programs such as SPE as described in "Determination and Use of Stability Constants", second edition, by A. E. Martell and R. J. Motekaitus, VCH, New York, N.Y., 1992.

A floppy disk containing the SPE program and instructions for running it are provided with the above-entitled book.

The total concentration of soluble silver species present in water at pH 7 was calculated for a variety of ligands at a ligand concentration of 0.01M using 5 mM silver benzotriazole as the silver source. The calculations were carried out as follows:

| Equilibria: | | | |
|---|---|---|---|
| H + bzt | Hbzt | $\beta_{0011}$ = [Hbzt]/[H][bzt] | (1) |
| H + L | HL | $\beta_{0101}$ = [HL]/[H][L] | (2) |
| 2H + L | $H_2L$ | $\beta_{0102}$ = $[H_2L]/[H]^2[L]$ | (3) |
| H + OH | $H_2O$ | $K_2$ = [H][OH] | (4) |
| Ag + bzt | Ag(bzt) | $K_{sp}$ = [Ag][bzt] | (5) |
| Ag + L | AgL | $\beta_{1100}$ = [AgL]/[Ag][L] | (6) |
| Ag + 2L | $AgL_2$ | $\beta_{1200}$ = $[AgL_2]/[Ag][L]^2$ | (7) |

Mass Balances $$S=[Ag]+[AgL]+[AgL_2]+[AgBzt] \quad (8)$$

$$S=[bzt]+[Hbzt] \quad (9)$$

$$L_T=[L]+[HL]+[H_2L]+[AgL]+2[AgL_2] \quad (10)$$

Equations ( 8 ) and ( 9 ) were combined and substituted with equilibrium definitions (1), (6), and (7) to give equation (11).

$$[Ag]+\beta_{1100}[Ag][L]+\beta_{1200}[Ag][L]^2=[bzt]+\beta_{0011}[H][bzt] \quad (11)$$

From (5) , [bzt]=$K_{sp}$/[Ag], therefore, $$[Ag+\beta_{1100}[Ag][L]+\beta_{1200}[Ag][L]^2=K_{sp}/[Ag]+\beta_{0011}[H]K_{sp}/[Ag] \quad (12)$$

From (10) and equilibria (2), (3), (6), and (7), $$L_T=[L]+\beta_{0101}[H][L]+\beta_{0102}[H]^2[L]+\beta_{1100}[Ag][L]+2\beta_{1200}[Ag][L]^2 \quad (13)$$

Quadratic equations (12) and (13 were solved simultaneously for [Ag] and [L]. For cases lacking a second hydrogen ion equilibrium, ($\beta_{0102}$) was omitted from the $\beta_{0102}[H]^2[L]$ term in (13). MATHCAD software (available from MathSoft, Inc., Cambridge, Mass.) was used to calculate the values of pAg and Solubility shown in Table I below.

TABLE I

| Ligand | pAg | Solubility (M) | $\log\beta_{1100}$ | $\log\beta_{1200}$ | $\log\beta_{0101}$ | $\log\beta_{0102}$ |
|---|---|---|---|---|---|---|
| None (Ag-bzt only) | 6.0 | $9.1 \times 10^{-7}$ | | | 8.4 | |
| 5-aminopentanol | 6.0 | $9.1 \times 10^{-7}$ | 3.4 | 7.6 | 10.9 | |
| hexylamine | 6.0 | $9.1 \times 10^{-7}$ | 3.5 | 7.6 | 10.6 | |
| nicotinamide | 6.1 | $1.1 \times 10^{-6}$ | 1.67 | 3.02 | 3.40 | |
| pyridine | 7.0 | $3.5 \times 10^{-7}$ | 2.1 | 4.2 | 5.3 | |
| 3-methyl-2-aminopyridine | 6.3 | $1.8 \times 10^{-6}$ | 2.4 | 4.9 | 7.08 | |

TABLE I-continued

| Ligand | pAg | Solubility (M) | $\log\beta_{1100}$ | $\log\beta_{1200}$ | $\log\beta_{0101}$ | $\log\beta_{0102}$ |
|---|---|---|---|---|---|---|
| pyrazole | 6.3 | $1.8 \times 10^{-6}$ | 2.11 | 4.24 | 2.61 | |
| succinimide | 6.4 | $1.9 \times 10^{-6}$ | 4.36 | 9.64 | 9.59 | |
| 2-aminopyridine | 6.4 | $2.0 \times 10^{-6}$ | 2.4 | 4.8 | 6.8 | |
| triazole | 6.4 | $2.3 \times 10^{-6}$ | 2.6 | 4.38 | 2.46 | 12.41 |
| imidazole | 7.0 | $8.6 \times 10^{-6}$ | 3.08 | 6.90 | 7.31 | |
| benzimidazole | 7.2 | $1.2 \times 10^{-5}$ | 3.1 | 6.25 | 5.5 | |
| 2,2'-bipyridine | 7.4 | $2.0 \times 10^{-5}$ | 3.00 | 6.70 | 4.40 | |
| 2-imidazolidine-thione | 9.0 | $9.3 \times 10^{-4}$ | 5.97 | 10.2 | 1.18 | |
| N,N'-dimethyl-thiourea | 9.1 | $9.4 \times 10^{-4}$ | 6.1 | 10.2 | 1.18 | |
| N,N'-diethyl-thiourea | 9.1 | $1.0 \times 10^{-3}$ | 6.0 | 10.3 | 1.18 | |
| thiourea | 9.2 | $1.4 \times 10^{-3}$ | 7.1 | 10.6 | 1.18 | |
| 5-chloro-phenanthroline | 9.3 | $1.8 \times 10^{-3}$ | 4.7 | 11.0 | 4.1 | |
| phenanthroline | 9.6 | $3.3 \times 10^{-3}$ | 5.00 | 12.10 | 4.90 | 6.87 |
| 5-methyl-phenanthroline | 9.7 | $4.5 \times 10^{-3}$ | 7.3 | 12.4 | 5.3 | |
| triphenyl-phosphine | 9.8 | $4.8 \times 10^{-3}$ | 8.2 | 14.1 | | |
| phenylmercapto-tetrazole | 10.0 | $1.0 \times 10^{-2}$ | 13.6 | 14.9 | 3.3 | |

The auxiliary ligand itself may also function as the required thermal solvent. However, if an additional thermal solvent is employed, the auxiliary ligand should be at least sparingly soluble therein, preferably at least 1% wt/wt and more preferably greater than 10% wt/wt.

Auxiliary ligands for silver found to be useful in the present invention, particularly when silver benzotriazole is employed as the silver salt oxidizing material, include 2,2'-bipyrimidine and derivatives thereof; 1,2,4-triazole and derivatives thereof, e.g., 3-phenyl-5-thienyl-1,2,4-triazole, 3-methyl-5-propyl-1,2,4-triazole and 3-methyl-5-heptyl-1,2,4-triazole; phosphines, e.g., triphenylphosphine; acyclic thioureas, e.g., N,N'-di-n-methyl, ethyl and butylthioureas and tetramethylthiourea; 3,6-dithia-1,8-octanediol; 6-substituted purines wherein the 6-position is substituted with —OR or —NHR' where R is hydrogen, alkyl, or aryl and R' is alkyl, e.g., 6-methoxypurine and 6-dodecylaminopurine; and, bidentate nitrogenous ligands having two nitrogen atoms which are both available to coordinate to the same silver atom, e.g., 4-azabenzimidazole and derivatives thereof, 2,2'-dipyridyls including 2,2'-dipyridyl, 4,4'-dimethyl-2,2'-dipyridyl and 4,4'-diphenyl-2,2'-dipyridyl and 1,10-phenanthrolines including 1,10-phenanthroline, 5-chloro-1,10-phenanthroline and 5-nitro-1,10-phenanthroline.

The auxiliary ligand may be present in any layer of the heat-developable photosensitive system of the present invention including the image-receiving layer. It may also be present in a layer on the image-receiving layer, in which case the layer also preferably contains a thermal solvent in which the ligand is soluble and a binder. Alternatively, water soluble ligands may be coated on the negative, i.e. on the layer comprising the photosensitive silver halide, before or after hardening of the gelatin layer has been accomplished. Preferably, water soluble ligands are coated on the image-receiving layer. If the silver assisted cleavage rate of the particular dye-providing material tends to be slow, it is preferred that the auxiliary ligand be present in a layer other than the image-receiving layer.

The auxiliary ligands are generally used in amounts which yield, after drying, a coating coverage of 0.1 to 36 mmol/m$^2$, preferably 1 to 24 mmol/m$^2$.

The photosensitive silver halide used in the present invention may be any photosensitive silver halide employed in the photographic art, such as, silver chloride, iodide, bromide, iodobromide, chlorobromide, etc., and it may be prepared in situ or ex situ by any known method including using a light-sensitive silver halide forming component in the presence of the silver salt oxidizing material so as to form the light sensitive silver halide in part of the silver salt oxidizer.

The photosensitive silver halide emulsions used in the present invention may be spectrally sensitized by any known method in order to extend the photographic sensitivity to wavelengths other than those absorbed by the silver halide. Examples of suitable sensitizers include cyanine dyes, merocyanine, styryl dyes, hemicyanine dyes and oxonole dyes.

In addition to spectral sensitization, the silver halide emulsion may be chemically sensitized using any method known in the photographic art.

The silver halide emulsion is generally added to each photosensitive layer in an amount calculated to give a coated coverage in the range of 0.5 to 8.0 mmol/m$^2$, preferably 0.5 to 4.0 mmol/m$^2$.

The silver salt oxidizing material should be relatively light stable and thermally stable under the processing conditions. The silver salt oxidizing material is generally an organic silver salt or silver salt complex as heretofore known in the art. Any organic compound known in the photographic art to be useful for forming the organic silver salt may be employed, see, e.g., those described in U.S. Pat. No. 4,729,942. See U.S. Pat. No. 4,260,677 for useful silver salt complexes. Since the ligands useful in the present invention do not generally act as silver halide solvents under the conditions of processing, the silver salt oxidizing material is not a silver halide.

Examples of suitable silver salt oxidizing materials include silver salts of carboxylic acids, e.g., behenic and stearic acids and silver salts of compounds having an imino group. Preferred silver salts are the organic silver salts having an imino group. The silver salts of benzotriazole and its derivatives have been found to give particularly good results in the heat-developable photosensitive systems of the present invention.

The silver salt oxidizing material used in the present invention can be prepared in a suitable binder by any known means and then used immediately without being isolated. Alternatively, the silver salt oxidizing material may be isolated and then dispersed in a suitable binder.

The silver salt oxidizing material is generally used in an amount ranging from 0.5 to 8.0 mmol/$m^2$, and preferably from 0.5 to 4.0 mmol/$m^2$.

The reducing agents which may be used in the present invention may be selected from among those commonly used in heat-developable photographic materials. Illustrative reducing agents useful in the present invention include hydroquinone and its derivatives, e.g., 2-chlorohydroquinone; aminophenol derivatives, e.g., 4-aminophenol and 3,5-dibromophenol; catechol and its derivatives, e.g., 3-methoxycatechol; phenylenediamine derivatives, e.g., N,N-diethyl-p-phenylenediamine; and, 3-pyrazolidone derivatives, e.g., 1-phenyl-3-pyrazolidone and 4-hydroxymethyl-4-methyl-1-phenyl-3-pyrazolidone. The preferred reducing agents are 1-phenyl-3-pyrazolidone (phenidone), and 4-hydroxymethyl-4- methyl-1-phenyl-3-pyrazolidone (dimezone-S).

The reducing agents may be used singly or in combination and they are generally employed in amounts ranging from 0.5 to 16.0 mmol/$m^2$, and preferably 1.0 to 8.0 mmol/$m^2$.

Thermal solvents are non-hydrolyzable compounds which are solids at ambient temperature but which melt at or below the temperature used for processing. The temperature at which the thermal solvent melts in the heat-sensitive system will generally be lower than the melting point of the thermal solvent itself and represents a mixed melting point resulting from the combination of the thermal solvent with one or more other components in the heat-sensitive system. The thermal solvent acts as a solvent for various components of the heat-developable image-recording materials, it helps to accelerate thermal development and it provides the medium for diffusion of various materials including silver ions and/or silver complexes, reducing agents and the dyes. As mentioned hereinbefore, the auxiliary ligand itself may function as the thermal solvent, e.g. 1,2,4-triazole, or a separate material may serve as the thermal solvent. In addition, two or more thermal solvents may be used in combination.

Illustrative thermal solvents useful in the present invention include polar organic compounds such as the polyglycols described in U.S. Pat. No. 3,347,675 and the compounds described in U.S. Pat. No. 3,667,959. Particularly useful compounds include urea derivatives, e.g., dimethylurea, diethylurea and phenylurea; amide derivatives, e.g., acetamide, benzamide and p-toluamide; sulfonamide derivatives, e.g., benzenesulfonamide and α-toluenesulfonamide; and polyhydric alcohols, e.g., 1,2-cyclohexanediol and pentaerythritol. Preferably, the thermal solvent is water insoluble. Water soluble thermal solvents may cause problems in storage of the dye-providing material during coating. The thermal solvent designated TS-1 and having the structure

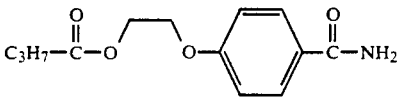

TS-1 has been found to give good results in the present invention.

The thermal solvent is generally incorporated on or in the image-receiving layer and/or in the photosensitive silver halide layer. However, it may also be added to any intermediate layers and protective layers where necessary to obtain a desired result.

The thermal solvent is generally added in each layer in amounts ranging from 0.25 to 10.0 g/$m^2$, preferably 0.5 to 5.0 g/$m^2$.

The photosensitive silver halide emulsion layer(s) and other layers of the heat-developable photosensitive image-recording materials may contain various materials as binders. Suitable binders include water soluble synthetic high-molecular weight compounds such as polyvinyl alcohol and polyvinylpyrrolidone and, synthetic or natural high-molecular weight compounds such as gelatin, gelatin derivatives, cellulose derivatives, proteins, starches and gum arabic. A single binder or mixture of binders may be used. Gelatin is the preferred binder for use in each layer.

The amount of binder used in each layer is generally 0.5 to 5.0 g/$m^2$, preferably 0.5 to 3.0 g/$m^2$.

The layers of the heat-developable photosensitive system according to the present invention which contain a crosslinkable colloid as a binder, e.g., gelatin, can be hardened by using various organic and inorganic hardeners such as those described in T. H. James, *The Theory of the Photographic Process,* 4th Ed., MacMillan, 1977, pp. 77–87. The hardeners can be used alone or in combination. It is preferred that the image-recording material according to the present invention contains a hardener in the photosensitive silver halide emulsion layer. Any suitable hardener known in the photographic art may be used, however, aldehyde hardeners, e.g., succinaldehyde and glyoxal, have been found to be particularly useful when gelatin is employed as the binder.

The hardeners are generally used in amounts ranging from 1 to 10% by weight of the total amount of gelatin coated.

The dye-providing materials include those materials described in copending U.S. patent application Ser. No. 07/923,843 of M. J. Arnost et al, filed Jul. 31, 1992, which, upon silver-ion assisted cleavage, release a diffusible complete dye, dye intermediate, or material which when released is colorless or of a color other than that ultimately desired in a certain environment, such as at a particular pH level, but upon change in environment, e.g. from acid to alkaline conditions, take on a color change, e.g. indicator dyes and leuco dyes. The dye-providing material must be substantially non-diffusible in the heat-processed image-recording materials before and during processing but be capable of undergoing cleavage in the presence of the imagewise distribution of silver ions and/or soluble silver complex made available in the undeveloped and partially developed areas of the photosensitive emulsion as a function of development to liberate a more mobile and diffusible dye-providing moiety in an imagewise distribution corresponding to the imagewise distribution of said ions and/or said complex. Suitable dye-providing materials are those containing at least one heterocyclic ring having a 1,3 sulfur-nitrogen moiety and at least one dye radical, which heterocyclic ring is subject to a cleavage reaction in the presence of silver ions and/or a soluble silver complex to release a diffusible dye, such as those disclosed in the aforementioned U.S. Pat. No.4,098,783 and copending U.S. patent applications Ser. No. 07/923,843 filed on Jul. 31, 1992, Ser. No. 07/994,897 filed on Dec. 22, 1992, and Ser. No. 08/058,494 filed on May 6, 1993. Preferred dye-providing materials include the thiazolidine dye-providing materials disclosed in the aforementioned U.S. patent and copending applications, and the dye-providing materials may be prepared by procedures described therein.

The dye-providing material may be added in the same layer as the photosensitive silver halide/silver salt oxidizer emulsion layer or in a layer on either side of the photosensitive emulsion layer. However, it is generally preferred that the dye-providing materials be placed so that exposure does not occur through the dye. If exposure is made through the dye, the dye may absorb some of the light needed to expose the silver halide. In certain instances, it may be desirable to separate the dye-providing material from the emulsion layer by a spacer layer. Where the particular dye-providing material chosen tends to be migratory during storage and/or thermal development of the photosensitive system, it is preferred that the dye-providing material be in a separate layer and more preferably, that it be in a layer furthest from the image-receiving layer.

The amount of dye-providing material used varies with the type chosen but generally an amount of 0.25 to 2.0 mmol/$m^2$ is used.

The dye-providing materials may be incorporated into the heat-processed image-recording materials by any suitable method. For example, the dye-providing materials can be dissolved in a low boiling and/or high boiling solvent and dispersed in the binder, they can be dispersed in aqueous solutions of suitable polymers, e.g., gelatin, by means of a ball mill, or they can be solvent coated using any organic solvent that will also dissolve gelatin, e.g., trifluoroethanol or dimethylsulfoxide (DMSO).

The support for the image-recording elements according to the present invention must necessarily be able to withstand the heat required for processing the image, and any suitable support can be employed such as those described in Research Disclosure No. 17029, issued June 1978. Specific examples of suitable supports include synthetic plastic films, such as, a polyester film, a polyvinyl chloride film or a polyimide film and paper supports, such as, photographic raw paper, printing paper, baryta paper and resin-coated paper. Preferably, a polyester film is used.

A subcoat may be added to the face of the support which carries the heat-developable photosensitive materials in order to increase adhesion. For example, a polyester base coated with a gelatin subcoat has been found to enhance adhesion of aqueous based layers.

The heat-developable photosensitive image-recording materials according to the present invention can be used to form monochrome or multicolor images. If the image-recording material is to be used to generate a full color-image, it generally has three different heat-developable light-sensitive layers each releasing a different color dye as a result of thermal development.

Where multicolor images are desired, one or more layers containing a scavenger for silver ion and/or soluble silver complex may be employed between the photosensitive emulsion layers to enhance color separation. By virtue of the silver scavenger layer(s) positioned between the emulsion layers, the migration of the imagewise distribution of soluble silver ions or soluble silver complex formed during processing of each emulsion layer is confined to the dye-providing material associated with each emulsion layer and prevented from diffusing into the dye-providing material associated with the other emulsion layer or layers. Silver scavengers which may be employed in the present invention include those described in U.S. Pat. No. 4,060,417, issued Nov. 29, 1977.

The heat-developable diffusion transfer materials of the present invention include those wherein the photosensitive silver halide emulsion layer(s) or thermographic imaging layer and the image-receiving layer are initially contained in separate elements which are brought into superposition subsequent or prior to exposure. After development the two layers may be retained together in a single element, i.e., an integral negative-positive film unit or they can be peeled apart from one another. Alternatively, rather than being in separate elements, the photosensitive layer(s) or thermographic imaging layer and the image-receiving layer may initially be in a single element wherein the negative and positive components are contained in a heat-developable laminate or otherwise retained together in an integral structure. After heat-development, the two layers may be retained together as a single element or they can be peeled apart from one another. Where the photosensitive silver halide emulsion layer(s) or thermographic imaging layer and the image-receiving layer are retained together as an integral negative-positive film unit, a masking layer, e.g., titanium dioxide, may be necessary to conceal the untransferred dye-providing material from the final image.

The photosensitive elements of the present invention may be exposed by any of the methods used in the photographic art, e.g., a tungsten lamp, a mercury vapor lamp, a halogen lamp, fluorescent light, a xenon flash lamp or a light emitting diode including those which emit infrared radiation.

The photosensitive material of the present invention is heat-developed after imagewise exposure. This is generally accomplished by heating the material at a temperature in the range of 80° to 200° C., preferably in the range of 100° to 150° C., for a period of from 1 to 720 seconds, preferably 1.5 to 360 seconds. In order to transfer the released dye to the image-receiving sheet, both heat and pressure must be applied simultaneously. Thus, pressure can be applied simultaneously with the heat required for thermal development by using heated rollers or heated plates. Alternatively, heat and pressure can be applied subsequent to thermal development in order to transfer the released dye.

All methods of heating that can be employed in heat-developable photosensitive systems known in the art may be applied to the heat-developable photographic material of the present invention. Thus, for example, heating may be accomplished by using a hot plate, an iron, heated rollers or a hot drum.

The thermographic materials of the present invention are imaged by heating imagewise using a method known in the art.

Any image-receiving layer which has the capability of receiving the dye released as a result of thermal processing may be used in the present invention. Typical image-receiving layers which can be used are prepared by coating a support material with a suitable polymer for receiving the dye. Alternatively, certain polymers may be used as both the support and the dye receiving material.

The image-receiving layer is generally superposed on the photosensitive negative after exposure and the two are then heated simultaneously to develop the image and cause the dye to transfer. Alternatively, the negative may be exposed and then processed with heat, followed by superposing the image-receiving sheet on the exposed and developed photosensitive material and applying heat and pressure to transfer the dye. The image-receiving layer is then generally peeled apart from the negative.

Suitable polymers to be coated on the image-receiving support to receive dye include polyvinyl chloride, poly(methyl methacrylate), polyester, and polycarbonate.

The support materials which may be used for the image-receiving layer can be transparent or opaque. Examples of suitable supports are polymer films, such as, polyethylene terephthalate, polycarbonate, polystyrene, polyvinyl chloride, polyethylene, polypropylene and polyimide. The above supports can be made opaque by incorporating pigments therein, such as, titanium dioxide and calcium carbonate. Other supports include baryta paper, resin coated paper having paper laminated with pigmented thermoplastic resins, fabrics, glass, and metals.

Resin coated paper has been found to be a particularly useful support material for the image-receiving layer according to the present invention.

Additionally, the thermographic and photothermographic image-recording materials of the present invention may include other materials heretofore suggested in the art but are not essential. These include, but are not limited to, antifoggants, antistatic materials, coating aids e.g, surfactants, activators and the like.

Also, the photosensitive elements may contain additional layers commonly used in the art, such as spacer layers, a layer of an antihalation dye, and/or a layer of a filter dye arranged between differentially color-sensitive emulsion layers. A protective layer may also be present in the image-recording material of the present invention. The protective layer may contain a variety of additives commonly employed in the photographic art. Suitable additives include matting agents, colloidal silica, slip agents, organofluoro compounds, UV absorbers, accelerators, antioxidants, etc.

The present invention is illustrated by the following specific examples.

In the following examples, the silver iodobromide dispersion is a 0.25 μm cubic unsensitized iodobromide (2% iodide) emulsion prepared by standard techniques known in the art. The silver salt oxidizer, thermal solvent, dye-providing material and reducing agents used in the Examples were added to the coating compositions as dispersions. The various dispersions were prepared by the specific procedures described below or by analogous procedures but using different reagents as noted. The auxiliary ligands were added to the coating compositions either as aqueous solutions or aqueous dispersions. If an aqueous dispersion was employed, it was prepared by an analogous procedure to that described below for the thermal solvent. The other components of the layers, e.g., succinaldehyde and Zonyl-FSN were added to the coating compositions as aqueous solutions.

(1) Silver Salt Dispersion 415 g of benzotriazole was added to 325 mL of concentrated ammonium hydroxide. To the resulting solution was added 450 g of gelatin and the mixture was diluted to a total volume of 6 liters with water. To this mixture, in the dark and at 40° C., was added with stirring, over a one-hour period, a mixture prepared by combining 550 g of silver nitrate with 500 mL of concentrated ammonium hydroxide and diluted to a total volume of 2.1 liters with water. The mixture stood at room temperature for about 60 minutes and then the material was washed using standard emulsion washing procedures and the pH adjusted to 6 and the pAg adjusted to 7.4.

(2) Thermal Solvent Dispersion 64 g of the thermal solvent designated TS-1, above, was dispersed in a mixture of 8.8 g of 10% aqueous polyvinylpyrrolidone, 10.8 g of 5% aqueous Alkanol XC (available from DuPont, Wilmington, Del.) and 160.4 g of water. The resulting mixture was ground in a ball mill for 7 hours. 100 g of water was introduced for washing purposes during the isolation of the dispersion.

(3) Dispersion of Dye-Providing Material 1.6 of dye-providing material, Compound A, having the structure

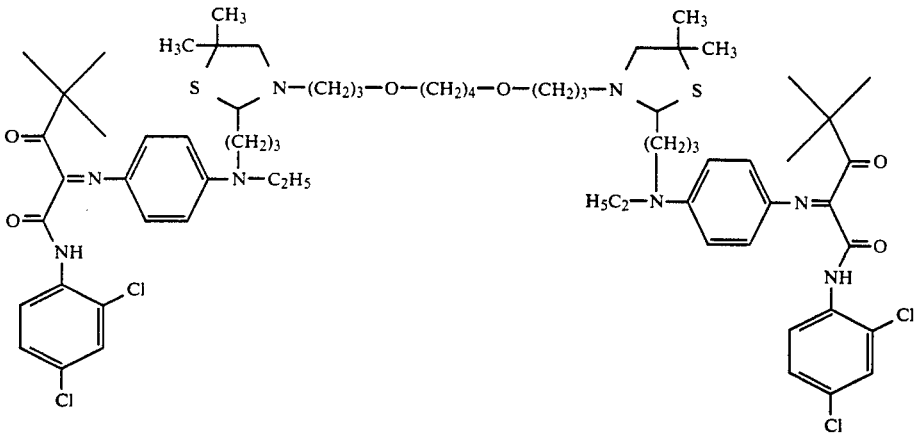

Compound A was dissolved in 5.0 g of ethyl acetate. 0.8 g of tricresylphosphate was added and the mixture was stirred and heated to 42° C. To the mixture at 42° C. was added a solution containing 21 g water, 4 g of 5% aqueous Alkanol XC and 8.5 g of 17.5% aqueous gelatin. The mixture was sonified with an ultrasonic probe for one minute in order to form a dispersion. The dispersion was stirred at 60° C. for 20 minutes to remove the ethyl acetate, followed by the addition of 14.1 g water.

(4) Reducing Agent Dispersion 3.0 g of 4-hydroxymethyl-4-methyl-l-phenyl-3-pyrazolidinone (Dimezone S) was added to 4.0 g of water and 3.0 g of 5% aqueous Alkanol XC. The resulting mixture was ground in a ball mill for 16 hours. The resulting dispersion was diluted with water during isolation.

EXAMPLE 1

A photothermographic material according to the present invention was prepared using the dispersions described above. A gelatin subcoated 4 mil polyester film (available from DuPont) was coated using a #30 Meyer Rod with an aqueous composition to yield dry coating coverages of the respective components of layer 1 as follows:

| Layer 1 | |
|---|---|
| Gelatin (Inert, deionized, derivatized bone gelatin, available from Rousselot, France) | 2000 mg/m$^2$ |
| Dye-providing material (Compound A) | 331 mg/$^2$ |

After air drying, layer 1 was overcoated with a composition (applied with a #30 Meyer Rod) to yield coated coverages of the respective components of layer 2 as follows:

| Layer 2 | |
|---|---|
| Gelatin | 3000 mg/m$^2$ |
| Thermal Solvent (TS-1) | 3000 mg/m$^2$ |
| Reducing Agent (Dimezone S) | 4.0 mmol/m$^2$ |
| Silver Benzotriazole | 2.0 mmol/m$^2$ |
| Silver Iodobromide | 2.0 mmol/m$^2$ |
| Succinaldehyde | 100 mg/m$^2$ |
| 1,2,4-Triazole | 12.0 mmol/m$^2$ |
| Zonyl FSN (perfluoroalkyl polyethylene oxide non-ionic surfactant, available from DuPont, Wilmington, DE) | 0.1% by wt. |

The photothermographic material was exposed to white light for $10^{-3}$ sec. An image-receiving sheet comprising a resin coated paper base overcoated with polyvinylchloride (12 g/m$^2$) was superposed on the exposed, heat-developable photosensitive material and the assembly was processed at 120° C. for 180 sec at a pressure of 35 psi using a heated plate.

The photosensitive layer and dye-providing layer were peeled apart from the image-receiving layer after cooling below the melting point of the thermal solvent (104° C.), approximately 5 sec after processing. The maximum reflection density (Dmax) and the minimum density (Dmin) of the resulting image were measured using a reflection densitometer (MacBeth, model RD 514). The measured values are reported in Table 1.

To provide a control, a photothermographic material was prepared, imaged, and processed as above, except that the auxiliary ligand, 1,2,4-triazole, was not used. The measured Dmax and Dmin of the final image are reported in Table 1.

TABLE 1

| | Dmax | Dmin |
|---|---|---|
| Example 1 | 1.28 | 1.04 |
| Control | 0.75 | 0.75 |

The foregoing data demonstrates that the presence of an auxiliary ligand (1,2,4-triazole) in the photosensitive silver halide layer of a two-layer negative enhanced the image density and discrimination of the transfer image.

EXAMPLE 2

A photothermographic material was prepared and exposed as described in Example 1, except that 1-phenyl-3-pyrazolidinone (phenidone) replaced Dimezone S as the reducing agent, the dye-providing material had the structure Compound B

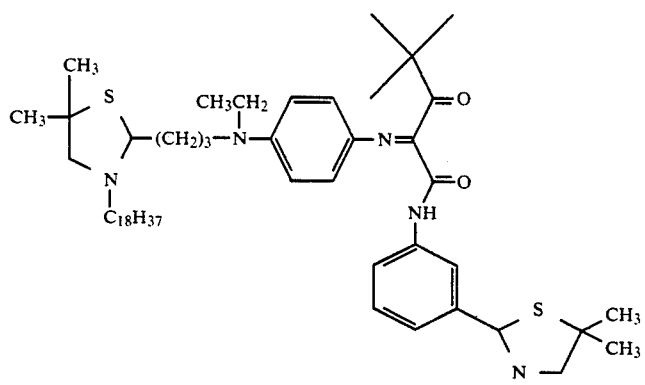

and, the negative was coated as a single layer instead of two layers. The dry coating coverages of the respective components was as follows:

| | |
|---|---|
| Gelatin | 3000 mg/m$^2$ |
| Thermal Solvent (TS-1) | 1500 mg/m$^2$ |
| Reducing Agent (Phenidone) | 4.0 mmol/m$^2$ |
| Silver Benzotriazole | 2.0 mmol/m$^2$ |
| Silver Iodobromide | 2.0 mmol/m$^2$ |
| Dye-Providing Material (Compound B) | 0.5 mmol/m$^2$ |
| Succinaldehyde | 170 mg/m$^2$ |
| 1,2,4-Triazole | 12.0 mmol/m$^2$ |
| Zonyl FSN | 0.1% by wt. |

After exposure to white light for $10^{-3}$ sec, an image-receiving sheet according to Example 1 was superposed on the exposed photosensitive material, and processed at 110° C. for 180 sec at a pressure of 35 psi. After cooling for approximately 5 sec, the image-receiving layer and negative layer were peeled apart. The Dmax and Dmin of the image were measured as in Example 1 and the values are reported in Table 2.

As a control, a heat-developable photosensitive material was prepared, imaged and processed as above except that the auxiliary ligand, 1,2,4-triazole, was not used. The measured Dmax and Dmin for the control are reported in Table 2.

TABLE 2

| | Dmax | Dmin |
|---|---|---|
| Example 2 | 0.62 | 0.43 |
| Control | 0.55 | 0.55 |

The foregoing data demonstrates that the presence of an auxiliary ligand in a one layer negative enhanced the image density and discrimination of the transfer image.

EXAMPLE 3

Two, 2-layer heat-developable photothermographic negative materials were prepared in a manner analogous to Example 1 except that glyoxal replaced the succinaldehyde and the auxiliary ligand was added onto the receiving sheet instead of in the negative as described below.

Two gelatin subcoated 4 mil polyester films were coated, using a #30 Meyer Rod, with an aqueous composition to yield dry coating coverages of the respective components of layer 1 and layer 2 as follows:

| | |
|---|---|
| Layer 1 | |
| Gelatin | 2000 mg/m$^2$ |
| Dye-providing material (Compound A) | 0.25 mmol/m$^2$ |
| Layer 2 | |
| Gelatin | 3000 mg/m$^2$ |
| Thermal Solvent (TS-1) | 1500 mg/m$^2$ |
| Reducing Agent (Dimezone S) | 4.0 mmol/m$^2$ |
| Silver Benzotriazole | 2.0 mmol/m$^2$ |
| Silver Iodobromide | 2.0 mmol/m$^2$ |
| Glyoxal | 100 mg/m$^2$ |

The image-receiving sheets were prepared as follows:

Two image-receiving sheets were prepared by coating two image-receiving sheets prepared according to Example 1 with compositions prepared so as to yield coating coverages after drying as follows:

| | (i) | (ii) |
|---|---|---|
| Gelatin | 500 mg/m$^2$ | 500 mg/m$^2$ |
| Thermal Solvent (TS-1) | 1000 mg/m$^2$ | 1000 mg/m$^2$ |
| Glyoxal | 20 mg/m$^2$ | 20 mg/m$^2$ |
| Auxiliary Ligand: | | |
| 4-Azabenzimidazole | 24 mmol/m$^2$ | — |
| 3,6-Dithia-1,8-octanediol | — | 2.4 mmol/m$^2$ |

The thus prepared negatives were each exposed to white light for $10^{-3}$ sec. Image-receiving sheet (i) was superposed on one of the negatives and image-receiving sheet (ii) was superposed on the other negative. Each assembly was then processed by heating at 110° C. for 180 sec. under pressure.

After cooling, the image-receiving sheets were peeled apart from the negatives. The reflection Dmax and Dmin were measured for each image and the values are reported in Table 3.

To provide a control, a photothermographic material was prepared, imaged and processed as above, except that no auxiliary ligand was added. The measured Dmax and Dmin of the final image are reported in Table 3.

TABLE 3

| | Dmax | Dmin |
|---|---|---|
| Example 3: | | |
| (i) | 0.58 | 0.36 |
| (ii) | 0.33 | 0.24 |

TABLE 3-continued

| | Dmax | Dmin |
|---|---|---|
| Control | 0.16 | 0.16 |

As the above data demonstrate, the presence of an auxiliary ligand on the image-receiving layer enhanced image density and discrimination in the transfer image.

EXAMPLE 4

This example demonstrates that increased image densities are obtained when an auxiliary ligand for silver ions is used in the heat-developable thermographic imaging materials of the present invention. The reflection densities obtained using 17 different auxiliary ligands were measured and compared to a control without an auxiliary ligand.

The 17, 2-layer thermographic imaging materials were prepared as in Example 1 except that the photosensitive silver iodobromide and the reducing agent were left out. The materials were imaged by heating, there was no exposure to light. The coated coverages of the respective components of layer 1 and layer 2 were as follows:

| | |
|---|---|
| Layer 1 | |
| Gelatin | 2000 mg/m$^2$ |
| Dye-providing material (Compound B) | 564 mg/m$^2$ |
| Thermal Solvent (TS-1) | 1500 mg/m$^2$ |
| Zonyl FSN | 0.1% by wt. |
| Layer 2 | |
| Gelatin | 3000 mg/m$^2$ |
| Thermal Solvent (TS-1) | 3000 mg/m$^2$ |
| Silver Benzotriazole | 2.0 mmol/m$^2$ |
| Succinaldehyde | 100 mg/m$^2$ |
| Auxiliary Ligand | 4.0 mmol/m$^2$ |
| Zonyl FSN | 0.1% by wt. |

The image-receiving sheets were prepared as in Example 1. The image-receiving sheets were superposed on the respective heat-developable materials and each was processed at 120° C. for 180 sec. at a pressure of 35 psi by using heated plates. The optical reflection density was measured for each material. The particular ligands and measured transfer densities are reported in Table 4.

As a control, a heat-developable material was prepared as above, except that no ligand was present. The measured reflection density is shown in Table 4.

TABLE 4

| Ligand | Density |
|---|---|
| 4-Azabenzimidazole | 0.47 |
| 1,2,4-Triazole | 0.47 |
| 3-Phenyl-5-thienyl-1,2,4-triazole | 0.43 |
| 3-Methyl-5-propyl-1,2,4-triazole | 0.74 |
| 3-Methyl-5-heptyl-1,2,4-triazole | 0.45 |
| 3,6-Dithia-1,8-octanediol | 0.85 |
| N,N'-di-n-Butylthiourea | 0.60 |
| Triphenylphosphine | 0.48 |
| 6-Methoxypurine | 0.47 |
| 6-Dodecylaminopurine | 0.58 |
| Tetramethylthiourea | 0.50 |
| 2,2'-Dipyridyl | 0.35 |
| 4,4'-Dimethyl-2,2'-dipyridyl | 0.51 |
| 4,4'-Diphenyl-2,2'-dipyridyl | 0.54 |
| 1,10-Phenanthroline | 0.65 |
| 5-Nitro-1,10-phenanthroline | 0.68 |
| 2,2'-Bipyrimidine | 0.68 |
| Control | 0.27 |

As the data demonstrate, higher transfer densities are obtained when an auxiliary ligand for silver ions is present in the heat-developable imaging materials according to the present invention.

As mentioned above and demonstrated in Example 4, the auxiliary ligands for silver ions according to the present invention can also be utilized in thermographic imaging materials in order to obtain higher image densities. In such systems, the thermographic media is heated imagewise to generate silver ions and/or a soluble silver complex which is then available to cleave the dye-providing material to release a diffusible dye.

EXAMPLE 5

This example demonstrates that accelerated silver development rates are achieved when an auxiliary ligand for silver ions is used in the heat-developable imaging materials of the present invention.

Eight gelatin subcoated 4 mil polyester films were coated using a #30 Meyer Rod with a coating composition having the same components in the same concentration as that used in layer 2 of Example 1, above, except that the auxiliary ligand was different in each and was added in an amount to give a coated coverage of 4 mmol/m$^2$. The resulting photosensitive negative materials were exposed to white light for $10^{-3}$ sec. The exposed material was processed at 120° C. for 10 sec against a polyester sheet using a heated plate. The negative was peeled apart from the polyester sheet and fixed in red light. The fixing was accomplished by washing in four baths as follows:

| | Component(s) | Time (minutes) |
|---|---|---|
| Bath 1: | Water | 5 |
| Bath 2: | Ammonium thiocyanate (100 g)<br>Methanol (500 ml)<br>Water (500 ml) | 23 |
| Bath 3: | Kodak Rapid Fixer ®<br>(acid hardening fixer) | 5 |
| Bath 4: | Water | 10 |

The coatings were then air-dried and the reduced silver coverage measured by x-ray fluorescence. The ligands and percentage of silver developed are reported in Table 5. The % of silver developed is the ratio of the amount of silver measured after processing for 10 seconds and fixing to the amount of silver coated.

As a control, a heat-developable photosensitive material was prepared and processed as above, except that an auxiliary ligand was not used. The % of silver developed for the control is reported in Table 5.

TABLE 5

| Ligand | % Silver developed |
|---|---|
| 1,2,4-Triazole | 44 |
| 3-Methyl-5-heptyl-1,2,4-triazole | 42 |
| Azabenzimidazole | 15 |
| 6-Dodecylaminopurine | 10 |
| N,N'-di-n-Butylthiourea | 30 |
| 5-Nitro-1,10-phenanthroline | 43 |
| 4,4'-Dimethyl-2,2'-dipyridyl | 47 |
| 4,4'-Diphenyl-2,2'-dipyridyl | 45 |
| Control | 6 |

As the data in Table 5 demonstrate, accelerated silver development is achieved when an auxiliary ligand for silver is present in the heat-developable imaging materials according to the present invention.

EXAMPLE 6

A thermographic imaging material was prepared imaged and processed in a manner analogous to Example 4 except that Layer 1 and Layer 2 had coated coverages of the following components:

| | |
|---|---|
| **Layer 1** | |
| Gelatin | 2000 mg/m$^2$ |
| Dye-providing material (Compound B) | 0.5 mmol/m$^2$ |
| Thermal Solvent (1,2,4-triazole) | 1500 mg/m$^2$ |
| Zonyl FSN | 0.1% by wt. |
| **Layer 2** | |
| Gelatin | 3000 mg/m$^2$ |
| 1,2,4-Triazole | 3000 mg/m$^2$ |
| Silver Benzotriazole | 2.0 mmol/m$^2$ |
| Succinaldehyde | 100 mg/m$^2$ |
| Zonyl FSN | 0.1% by wt. |

As a control, a thermographic imaging material was prepared, imaged and processed as above, except that silver benzotriazole was not used. The optical reflection density for each material is reported in Table 6.

TABLE 6

| | Density |
|---|---|
| Example 6 | 0.72 |
| Control | 0.05 |

The above data demonstrates that the auxiliary ligand, specifically triazole, may function as both the ligand and the thermal solvent. The control demonstrates that the transfer density is due to released dye and not the uncleaved dye-providing material indicating that triazole acts as a thermal solvent for the released dye but not for unreleased dye-providing material.

EXAMPLE 7

Seven thermographic imaging materials were prepared and processed in a manner analogous to Example 4 described above except that silver iodobromide replaced silver benzotriazole as the source of silver ions made available to cleave the dye-providing material. The gelatin subcoated 4 mil polyester films used above were each coated with an aqueous composition to yield dry coating coverages of the respective components of Layers 1 and 2 as follows:

| | |
|---|---|
| **Layer 1** | |
| Gelatin | 2000 mg/m$^2$ |
| Dye-providing material (Compound B) | 0.5 mmol/m$^2$ |
| Thermal Solvent (TS-1) | 1500 mg/m$^2$ |
| Zonyl FSN | 0.1% by wt. |
| **Layer 2** | |
| Gelatin | 3000 mg/m$^2$ |
| Thermal Solvent (TS-1) | 3000 mg/m$^2$ |
| Silver iodobromide | 2.0 mmol/m$^2$ |
| Succinaldehyde | 100 mg/m$^2$ |
| Zonyl FSN | 0.1% by wt. |

Seven image-receiving sheets, the same as used in Example 4, were each overcoated with a different auxiliary ligand, as follows:

| | |
|---|---|
| Gelatin | 500 mg/m$^2$ |
| Thermal Solvent (TS-1) | 1000 mg/m$^2$ |
| Ligand | (See Table 7) |
| Zonyl FSN | 0.1% by wt. |

-continued

| | |
|---|---|
| Succinaldehyde | 10 mg/m$^2$ |

The specific ligand used for each sheet and the amount coated is reported in Table 7.

The image-receiving sheets were superposed on the heat-developable materials, and each was processed at 120° C. for 180 sec. at a pressure of 35 psi by using heated plates. The optical reflection density was measured for each material. The particular ligands and measured transfer densities are reported in Table 7.

As a control, a thermographic material was prepared as above, except that there was no ligand present in the image-receiving sheet.

TABLE 7

| Ligand | Coverage (mmol/m$^2$) | Density |
|---|---|---|
| 2,2'-bipyridine | 6.5 | 0.18 |
| 1,2,4-triazole | 12.0 | 0.25 |
| 1,10-phenanthroline | 4.0 | 0.10 |
| 1,10-phenanthroline | 12.0 | 0.15 |
| 5-nitro-1,10-phenanthroline | 4.4 | 0.15 |
| 4-azabenzimidazole | 12.0 | 0.38 |
| 4-azabenzimidazole | 24.0 | 0.39 |
| Control | (none) | 0.21 |

The foregoing data, particularly that in Table 7, demonstrates that the ligands according to the present invention do not generally function as silver halide solvents in the heat-developable image-recording materials of the present invention. The only exception to this is 4-azabenzimidazole which acts as both a ligand for the silver salt oxidizing material (see Example 4 and corresponding Table 4) and as a silver halide solvent.

EXAMPLE 8

Two thermographic imaging materials were prepared and imaged as in Example 4 except that the ligands were replaced with materials known to be useful as silver halide solvents in wet processed photographic imaging systems. The optical reflection density was measured for each image. The particular silver halide solvent and measured transfer densities are reported in Table 8.

As a control, a thermographic material was prepared and imaged as above, except that there was no silver halide solvent. The measured reflection density is shown in Table 8.

TABLE 8

| Silver Halide Solvent | Density |
|---|---|
| Hypoxanthine | 0.28 |
| Propylene thiourea | 0.23 |
| Control | 0.27 |

The above data demonstrate that materials useful as silver halide solvents in wet processed photographic imaging systems do not function as auxiliary ligands for the silver salt oxidizing materials according to the present invention.

The heat-developable imaging materials prepared and processed in Examples 1–8, above, were processed base-free, i.e., they did not contain any added base or base-precursor and they were processed water free, i.e., no water was added to aid in development or transfer. It is recognized that while certain of the auxiliary ligands may be classified as weak bases, such ligands would not be considered to be bases or base-precursors as those terms are used in Japanese Kokai No. 59-180548. The auxiliary ligands, however, may also be used in heat-developable imaging materials containing a base or base-precursor such as those disclosed in the aforementioned Japanese Kokai No. 59-180548.

Since certain changes may be made in the above subject matter without departing from the spirit and scope of the invention herein involved, it is intended that all matter contained in the above description and the accompanying examples be interpreted as illustrative and not in any limiting sense.

We claim:

1. A heat-processed color image-recording material comprising (a) a support carrying in one or more layers a dye-providing material capable of releasing a diffusible dye upon cleavage in the presence of silver ions and/or a soluble silver complex, a thermal solvent, an organic silver salt oxidizing material, and a binder and, (b) on the same or a second support an image-receiving layer capable of receiving the diffusible dye released from said dye-providing material, said image-recording material additionally includes an auxiliary ligand capable of complexing with the silver ions of said silver salt oxidizing material, said ligand dissolving sufficient silver salt oxidizing material to provide a total concentration of mobile silver species greater than or equal to twice the concentration obtained in the absence of the auxiliary ligand.

2. A heat-processed image-recording material according to claim 1 which additionally includes a photosensitive silver halide.

3. A heat-processed image-recording material according to claim 2 which includes a reducing agent.

4. A heat-processed image-recording material according to claim 1 wherein said thermal solvent and said auxiliary ligand are the same material.

5. A heat-processed image-recording material according to claim 4 wherein said thermal solvent and said auxiliary ligand are 1,2,4-triazole.

6. A heat-processed image-recording material according to claim 1 wherein said image-recording material is free of base and base precursor.

7. A heat-processed image-recording material according to claim 1 which includes a second thermal solvent.

8. A heat-processed image-recording material according to claim 1 wherein said silver salt oxidizing material is silver benzotriazole.

9. A heat-processed image-recording material according to claim 3 wherein said photosensitive silver halide, silver salt oxidizing material, reducing agent, and the binder are in a layer separate from said dye-providing material.

10. A heat-processed image-recording material according to claim 9 wherein the layer comprising the dye-providing material additionally contains a binder for said dye-providing material.

11. A heat-processed image-recording material according to claim 10 wherein the layer comprising the dye-providing material additionally contains a thermal solvent.

12. A heat-processed image-recording material according to claim 3 wherein said auxiliary ligand is on the layer comprising said photosensitive silver halide.

13. A heat-processed image-recording material according to claim 3 wherein said auxiliary ligand is in the layer containing the silver salt oxidizing material.

14. A heat-processed image-recording material according to claim 3 wherein said auxiliary ligand is in a layer on said image-receiving layer.

15. A heat-processed image-recording material according to claim 3 wherein said auxiliary ligand is in said image-receiving layer.

16. A heat-processed image-recording material according to claim 14 wherein a thermal solvent is present in a binder coated on said image-receiving layer.

17. A heat-processed image-recording material according to claim 1 wherein said dye-providing material comprises at least one cyclic 1,3-sulfur-nitrogen moiety and at least one complete dye radical.

18. A heat-processed image-recording material according to claim 17 wherein said dye-providing material is a thiazolidine dye-providing material.

19. A heat-processed image-recording material according to claim 17 wherein said dye-providing material is a bis(thiazolidine dye).

20. A heat-processed image-recording material according to claim 8 wherein said auxiliary ligand is selected from the group consisting of 2,2'-bipyrimidine and derivatives thereof; 1,2,4-triazole and derivatives thereof; phosphines; acyclic thioureas; 3,6-dithia-1,8-octanediol; 6-substituted purines wherein the 6-position is substituted with —OR or —NHR' where R is hydrogen, alkyl, or aryl and R' is alkyl; and bidentate nitrogenous ligands having two nitrogen atoms which are both available to coordinate the same silver atom.

21. A heat-processed image-recording material according to claim 8 wherein said auxiliary ligand is 1,2,4-triazole.

22. A heat-processed image-recording material according to claim 8 wherein said auxiliary ligand is 3,6-dithia-1,8-octanediol.

23. A heat-processed image-recording material according to claim 8 wherein said auxiliary ligand is selected from 4-azabenzimidazole and derivatives thereof.

24. A heat-processed image-recording material according to claim 8 wherein said auxiliary ligand is selected from 2,2'-dipyridyl and derivatives thereof.

25. A heat-processed image-recording material according to claim 8 wherein said auxiliary ligand is selected from 1,10-phenanthroline and derivatives thereof.

26. A heat-processed image-recording material according to claim 3 wherein said binder is gelatin.

27. A heat-processed image-recording material according to claim 26 wherein said layer containing the silver halide has been hardened.

28. A method of thermal imaging comprising heating in an imagewise manner a heat-processed image recording material comprising (a) a support carrying in one or more layers a dye-providing material capable of releasing a diffusible dye upon cleavage in the presence of silver ions and/or a soluble silver complex, a thermal solvent, a silver salt oxidizing material, and a binder and, (b) on the same or a second support an image-receiving layer capable of receiving the diffusible dye released from said dye-providing material, said image-recording material additionally includes an auxiliary ligand capable of complexing with the silver ions of said silver salt oxidizing material, said ligand dissolving sufficient silver salt oxidizing material to provide a total concentration of silver species greater than or equal to twice the concentration obtained in the absence of the auxiliary ligand.

29. A method of photothermographic imaging including the steps of exposing a photosensitive image-recording material comprising (a) a support carrying in one or more layers a dye-providing material capable of releasing a diffusible dye upon cleavage in the presence of silver ions and/or a soluble silver complex, a thermal solvent, an organic silver salt oxidizing material, a binder, a photosensitive silver halide, and a reducing agent, and (b) on the same or a second support an image-receiving layer capable of receiving the diffusible dye released from said dye-providing material, said image-recording material additionally includes an auxiliary ligand capable of complexing with the silver ions of said silver salt oxidizing material, said ligand dissolving sufficient silver salt oxidizing material to provide a total concentration of mobile silver species greater than or equal to twice the concentration obtained in the absence of the auxiliary ligand, and either simultaneously with exposure or subsequently to exposure heating said photosensitive material.

30. A heat-processed color image-recording material comprising:

(a) a support carrying in one or more layers a dye-providing material capable of releasing a diffusible dye upon cleavage in the presence of silver ions and/or a soluble silver complex, a thermal solvent, a silver salt oxidizing material, a binder; and (b) on the same or a second support an image-receiving layer capable of receiving diffusible dye released from said dye-providing material, said image-recording layer additionally includes an auxiliary ligand capable of complexing with silver ions of said silver salt oxidizing material, said ligand dissolving sufficient silver salt oxidizing material to provide a total concentration of mobile silver species greater than or equal to twice the concentration obtained in the absence of said auxiliary ligand;

and said thermal solvent and said auxiliary ligand consisting of the same material.

31. A heat-processed image-recording material according to claim 30 which additionally includes a photosensitive silver halide and a reducing agent.

32. A heat-processed color image-recording material according to claim 30 further characterized by said image-recording material excluding water, base, and base precursor.

33. A heat-processed image-receiving material according to claim 30 wherein said thermal solvent and said auxiliary ligand are 1,2,4-triazole.

34. A method of photothermographic imaging including the steps of exposing a photosensitive image-recording material comprising:

(a) a support carrying in one or more layers a dye-providing material capable of releasing a diffusible dye upon cleavage in the presence of silver ions and/or a soluble silver complex, a thermal solvent, a silver salt oxidizing material, a binder, a photosensitive silver halide, and a reducing agent; and (b) on the same or a second support an image-receiving layer capable of receiving diffusible dye released from said dye-providing material, said image-recording layer additionally includes an auxiliary ligand capable of complexing with silver ions of said silver salt oxidizing material, said ligand dissolving sufficient silver salt oxidizing material to provide a total concentration of mobile silver species greater than or equal to twice the concentration obtained in the absence of said auxiliary ligand, said thermal solvent and said auxiliary ligand consisting of the same material;

and either simultaneously with exposure or subsequently to exposure heating said photosensitive material.

35. A method according to claim 34 further characterized by said photosensitive image-recording material excluding water, base, and base precursor.

36. A method according to claim 34 wherein water is not added to said photosensitive image-recording material.

37. A method according to claim 28 wherein water is not added to said heat-processed image recording material.

38. A method according to claim 29 wherein water is not added to said photosensitive image-recording material.

* * * * *